US007437972B2

(12) United States Patent
Yeager

(10) Patent No.: US 7,437,972 B2
(45) **Date of Patent: *Oct. 21, 2008**

(54) APPARATUS FOR FASTENING AND LOOSENING A LID FROM A CONTAINER

(75) Inventor: Arthur F. Yeager, Columbia, SC (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/603,254

(22) Filed: Nov. 22, 2006

(65) Prior Publication Data

US 2007/0107554 A1 May 17, 2007

Related U.S. Application Data

(63) Continuation-in-part of application No. 11/133,444, filed on May 20, 2005, now Pat. No. 7,204,171.

(60) Provisional application No. 60/572,476, filed on May 20, 2004.

(51) Int. Cl.
*B67B 7/14* (2006.01)
*B67B 7/84* (2006.01)
*B67B 3/20* (2006.01)

(52) U.S. Cl. ..... 81/3.33; 81/3.37

(58) Field of Classification Search ..... 81/3.2, 81/3.25, 3.29, 3.32, 3.33, 3.37
See application file for complete search history.

(56) References Cited

U.S. PATENT DOCUMENTS

| | | | | |
|---|---|---|---|---|
| 80,583 | A | 8/1868 | Allard | |
| 352,659 | A | 11/1886 | Petersen | |
| 1,365,405 | A | 1/1921 | Howard | |
| 1,689,301 | A * | 10/1928 | Ryckman | 30/433 |
| 1,821,194 | A | 9/1931 | Wilcox | |
| 3,159,064 | A | 12/1964 | Woloszyn | |
| 3,795,158 | A * | 3/1974 | Morita | 81/3.32 |
| 3,812,742 | A | 5/1974 | Polasek | |
| 3,971,188 | A | 7/1976 | Cawrse | |
| 4,171,650 | A * | 10/1979 | Cardinal | 81/3.2 |
| 4,358,970 | A | 11/1982 | Jacobson | |

(Continued)

FOREIGN PATENT DOCUMENTS

| | | |
|---|---|---|
| WO | WO8803510 | 5/1988 |

OTHER PUBLICATIONS

Amazon.com, Black & Decker Lids off Jar Opener, printed on Sep. 28, 2004 from www.amazon.com, p. 1.

(Continued)

*Primary Examiner*—David B Thomas
(74) *Attorney, Agent, or Firm*—Elizabeth Arwine

(57) ABSTRACT

The device performs the function of opening and/or closing lids attached to containers, and more particularly child-proof lids in at least some embodiments. The device preferably includes a base, a post, a lever, a plate to engage the lid of a container, and a mechanism that coverts movement of the lever to rotational movement of the plate against a lid. The conversion mechanism in at least some embodiments includes a spring.

24 Claims, 12 Drawing Sheets

U.S. PATENT DOCUMENTS

| | | | | | |
|---|---|---|---|---|---|
| 4,569,281 | A | | 2/1986 | Woods | |
| D286,734 | S | | 11/1986 | Furman | |
| 4,852,431 | A | | 8/1989 | Frangel | |
| 5,054,266 | A | | 10/1991 | Mello et al. | |
| 5,165,310 | A | | 11/1992 | Heinrich | |
| 5,167,172 | A | * | 12/1992 | Heebner | 81/3.2 |
| 5,207,125 | A | * | 5/1993 | Pierce, Jr. et al. | 81/3.43 |
| 5,329,831 | A | * | 7/1994 | Pierce, Jr. et al. | 81/3.43 |
| 5,353,665 | A | * | 10/1994 | Heebner | 81/3.2 |
| 5,996,441 | A | * | 12/1999 | Bateman | 81/3.2 |
| 6,263,761 | B1 | | 7/2001 | Ryder | |
| 6,651,531 | B1 | | 11/2003 | Thornton | |
| 6,862,954 | B2 | * | 3/2005 | Dubois et al. | 81/3.2 |
| 6,874,389 | B1 | * | 4/2005 | Thornton | 81/3.2 |
| 7,024,965 | B2 | | 4/2006 | Tremblay | |
| 7,204,171 | B2 | * | 4/2007 | Yeager | 81/3.33 |
| 2005/0132845 | A1 | | 6/2005 | Chervak et al. | |

OTHER PUBLICATIONS

Bed Bath & Beyond, Black & Decker Lids Off Automatic Jar Opener, printed on May 7, 2004 from www.bedbathandbeyond.com, p. 1 with enlarged image attached.

Jermanco, Jaromatic Automatic Jar Opener, printed on Sep. 28, 2004 from www.jaromatic.com, pp. 1-2.

Linens-N-Things, Under Cover Sale Booklet, , May 2004, p. 5.

The Home Marketplace, Black & Decker Lids Off Jar Opener, printed on Sep. 28, 2004 from www.thehomemarketplace.com, p. 1.

* cited by examiner 166
164
162
166

144
168

150
153
154
158
1582
1441

150
142
1441
144
156
1444
154

142
1422
1421

122
1444
1441
154
156
146
142
144
1421
1422
1446
132
120
110

APPARATUS FOR FASTENING AND LOOSENING A LID FROM A CONTAINER

This patent application is a continuation-in-part patent application of U.S. patent application Ser. No. 11/133,444, filed May 20, 2005 now U.S. Pat. No. 7,204,171, which claims the benefit of U.S. Provisional Patent Application No. 60/572,476, filed May 20, 2004. These patent applications are hereby incorporated by reference.

I. FIELD OF THE INVENTION

The present invention relates generally to devices for securing and unsecuring lids from containers, and more specifically, a device for tightening and loosening child-resistant lids from pill containers.

II. BACKGROUND OF THE INVENTION

Medical conditions such as Thoracic Outlet Syndrome and Carpal Tunnel Syndrome are sometimes grouped together under the name Cumulative Trauma Disorder (CTD) or Repetitive Stress Injury (RSI). These conditions are often caused by repetitive movements or motions. For example, data entry personnel often experience Carpal Tunnel Syndrome due to the constant and repetitive motions performed by their fingers depressing keys on a keyboard. Medical professionals such as pharmacists and nurses sometimes experience similar medical ailments due to repetitively placing lids or covers on pill bottle containers, for example. Due to the aforementioned conditions and other medical conditions (for example, arthritis, bursitis, and tendonitis), engaging in simple day-to-day activities such as placing the cover on a pill bottle can become challenging to some affected individuals.

For example, many senior citizens suffer from medical ailments such as inflammation of the joints of the fingers. As a result, these individuals are sometimes required to consume medication to assist in treating the ailments. Ironically, however, some of the individuals experience so much pain or discomfort from the ailments that they cannot open containers including their medication bottles. Handicapped individuals sometimes experience a similar problem. For example, hand or arm amputees with one real hand and possibly a prosthetic hand sometimes struggle to hold a pill bottle with their prosthetic, as they attempt to twist the lid off of the pill container with their good hand. Such a struggle may result in frustration and discouragement from consuming medication.

Child proof medicine bottles have lids that only need to be turned a little ways once depressed, but this is a different task for individuals with limited hand strength and dexterity and nearly impossible for certain C-spine injuries or stroke victims. Use of an electric powered device to open these containers would be overkill and potentially lead to an injury of the user if the lid (or cap) was turned too much while the user was holding the container resulting in the container being twisted out of the user's grasp. Additionally, electric powered devices are primarily used to perform multiple rotations during each activation, which is in excess of the minimal little turn of the cap needed to open a child proof medicine bottle.

Notwithstanding the usefulness of the above-described methods, a need still exists for a simple hand powered apparatus for easily loosening and fastening lids on containers, in particular child proof lids on medicine bottles.

III. SUMMARY OF THE INVENTION

Illustrative, non-limiting embodiments of the present invention overcome the aforementioned and other disadvantages associated with opening and closing child-proof containers. Also, the present invention is not required to overcome the disadvantages described above and an illustrative non-limiting embodiment of the present invention may not overcome any of the problems described above.

Various exemplary embodiments address some or all of the ongoing and recurring problems that occur when dealing with opening and closing containers with lids.

According to at least one embodiment of the invention, the invention includes a device for loosening and/or tightening a lid onto a container, the device including: a base, a post connected to the base, an arm connected to the post, a lever in rotational communication with the arm, a head, and a rotating means for rotating the head based on movement of the lever. At least one further embodiment provides for the rotating means to include an outer shaft linear engagement of the gear, an inner shaft in communication with the outer shaft, and a spring in communication with the inner shaft and the head.

According to at least one embodiment of the invention, the invention includes a device for loosening and/or tightening a lid onto a container, the device including: a base, a post connected to the base, an arm connected to the post, the arm including a sleeve, a lever in rotational communication with the arm, a gear connected to the lever and housed within the arm, an outer shaft including a rack engaging the gear and journaled with the sleeve, an inner shaft connected to the outer shaft, the inner shaft including a barrier internal to the inner shaft and a plurality of teeth around a bottom of the inner shaft, a spring in communication with the barrier and internal to the inner shaft, a head in communication with the spring, the head having a top surface, a plurality of teeth spaced from each other and extending from the top surface capable of engaging the plurality of teeth of the inner shaft, a post extending up from the top surface from a point within the plurality of teeth, the post encircled by the spring, and a bottom surface opposing the top surface.

According to at least one embodiment of the invention, the invention includes a device for loosening and/or tightening a lid onto a container, the device including: a base with at least one protrusion having a circular shape, a controlling means for controlling the operation of the device, a lid contacting means for contacting a lid of a container and rotating the lid, a rotational means for rotating the lid contacting means in response to use of the controlling means, a means for placing the rotational means over the base.

According to at least one embodiment of the invention, the invention includes a device that includes a base, a post connected to the base, a slide track connected to the post, a slide member in sliding engagement of the slide track, a bracket extending from the slide member away from the post, a lever connected to the post and the bracket, a bar connecting the free ends of the bracket and connecting the lever to the bracket, a cylindrical member depending from the support member, the cylindrical member having a closed bottom with a bottom surface and a pair of V-shaped slots on opposing sides of the outer shaft through which the bar passes, a spring located between the bar and the closed bottom of the cylindrical member, and a selector sleeve on the inside of the cylindrical member and around the spring, the selector sleeve having a pair of triangular (or cover) members on opposing surfaces and a member extending from the sleeve, the extending member abuts the cylindrical member.

According to at least one embodiment of the invention, the invention includes a device for use in loosening and tightening lids onto containers where the device includes a base, a post connected to the base, a lever in communication with the post, and means for converting movement of the handle into downward pressure on a container lid prior to rotating the lid with direction of rotation selected by the user.

An objective of the invention is to allow individuals with certain physical limitations to independently open a child-proof medicine bottle (or container).

Given the following enabling description of the drawings, the apparatus should become evident to a person of ordinary skill in the art.

IV. BRIEF DESCRIPION OF THE DRAWINGS

The aspects of the present invention will become more readily apparent by describing in detail illustrative, non-limiting embodiments thereof with reference to the accompanying drawings.

The use of cross-hatching within these drawings should not be interpreted as a limitation on the potential materials used for construction of the invention. Like reference numerals in the figures represent and refer to the same element or function.

V. DETAILED DESCRIPTION OF THE DRAWINGS

Figure 1B:
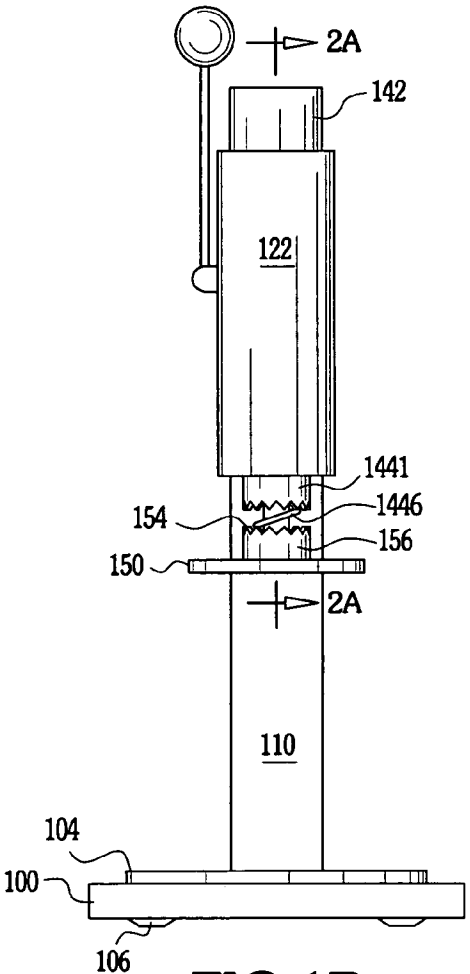
FIGS. 1A and 1B illustrate side views of an exemplary embodiment according to the invention.

Exemplary, non-limiting, embodiments of the present invention are discussed in detail below. While specific configurations are discussed to provide a clear understanding, it should be understood that the disclosed configurations are provided for illustration purposes only. A person of ordinary skill in the art will recognize that other configurations may be used without departing from the spirit and scope of the invention.

The invention in the illustrated exemplary embodiments includes a base on which a container sits and means for rotating a lid of the container to selectively open or close the lid of the container. The rotating means includes an engagement head (or plate) connected to a lever (or handle) that is capable of causing the engagement head to rotate the lid relative to the container to either loosen (open) or tighten (close) the lid. The rotating means turns the lid in a clockwise or counterclockwise direction depending upon the selected operation, which in some embodiments is accomplished through closing off part of a V-shaped channel and in other embodiments is accomplished through a switch and/or cover. In some of the embodiments, the lever directly drives a shaft down to apply a force through the engagement head onto the lid prior to beginning to rotate the engagement head. In other embodiments, the lever drives the shaft down through a gear.

FIGS. 1A-5 illustrate exemplary embodiments having a base 100, a post (or support member) 110 extending up from the base 100, an arm 120 attached to the post 110 and extending over the base 100, a lever 130 connected to the arm 120, a drive system (or means for rotating the head based on movement of the lever) 140, and an engagement head 150 connected to the drive system 140. This arrangement places the drive system 140 over where the container 190 is placed on the base 100 so that the drive system 140 can be lowered onto the container 190, and as such a variety of structures can be substituted for the post 110 and the arm 120 to facilitate this arrangement.

Figure 1A:
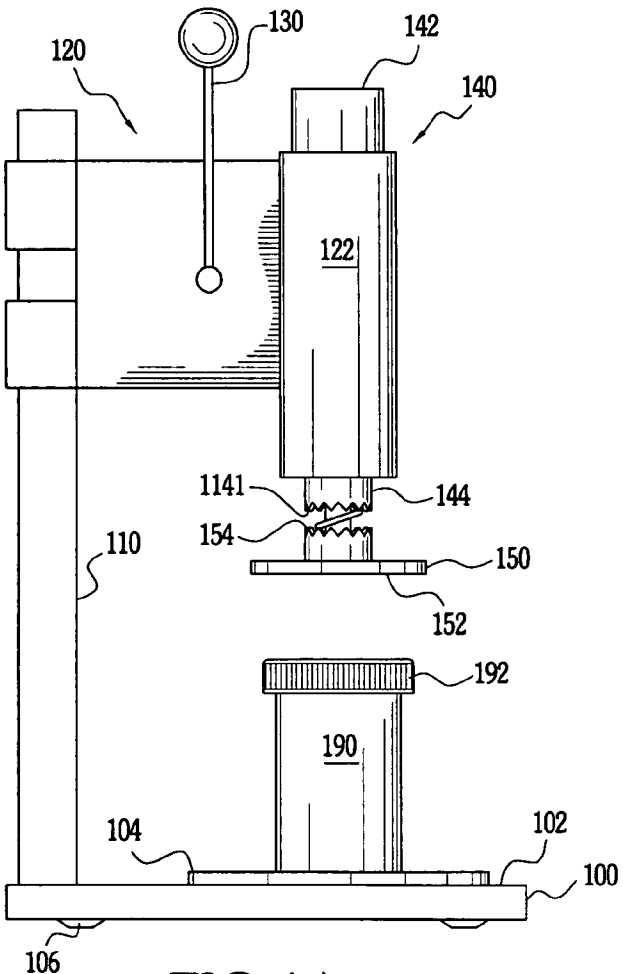
Figure 7A:
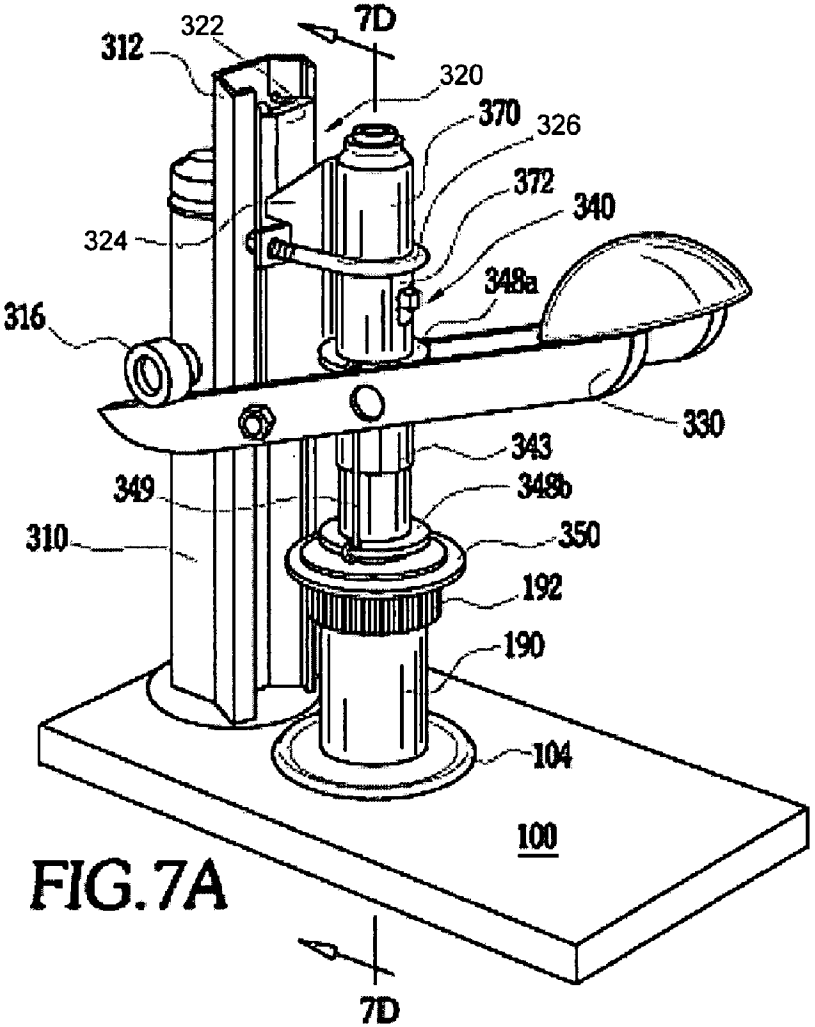
FIG. 7A illustrates a perspective view of an exemplary embodiment according to the invention.

The base 100 preferably includes a top surface 102 on which the container is placed. The top surface 102 as illustrated includes a plurality of circular ridges (or protrusions) 104 (illustrated in, for example, FIG. 7A) sized to fit different typical sizes of medicine (or pill) containers 190, although the ridges may be omitted. The area around the ridges 104 is preferably made of a material that is able to frictionally restrain the container during the opening and closing of the lid. An exemplary material is rubber, and more particularly Dycem™. The entire base 100 may be made of this material, the top surface 102 may be coated with this material, or just the area proximate the area defined by the ridges 104. The base 100 as illustrated includes a plurality of footings 106 to prevent sliding of the device across a work surface during use. Although, for example, FIGS. 1A and 1B illustrate the base 100 as rectangular, the base 100 may have any shape and any size that will provide stability for the device and allow for placement of a container 190 on it for opening/closing a lid 192. Other exemplary shapes include square, oval, triangle, and other polygons.

The post 110 is connected to the base 100 and places the arm 120 above the work area, which allows placement of the container 190 below the engagement head 150. Although not illustrated in FIGS. 1-5, the arm in at least one embodiment could be height adjustable up and down the post.

The lever 130 is connected to a gear 132 that is internal to and housed within the arm 120. The arm 120 includes a sleeve 122 through which the drive system 140 passes. The sleeve 122 as illustrated in, for example, FIG. 2A includes a slot for the gear 132 to engage the drive system 140. As the lever 130 is rotated towards the user, the drive system 140 is lowered towards the lid 192 causing the drive system 140 to eventually rotate the engagement head 150 and lid 192 relative to the container 190.

Figures 2A, 2B, 3, 4, 5A, 5B:
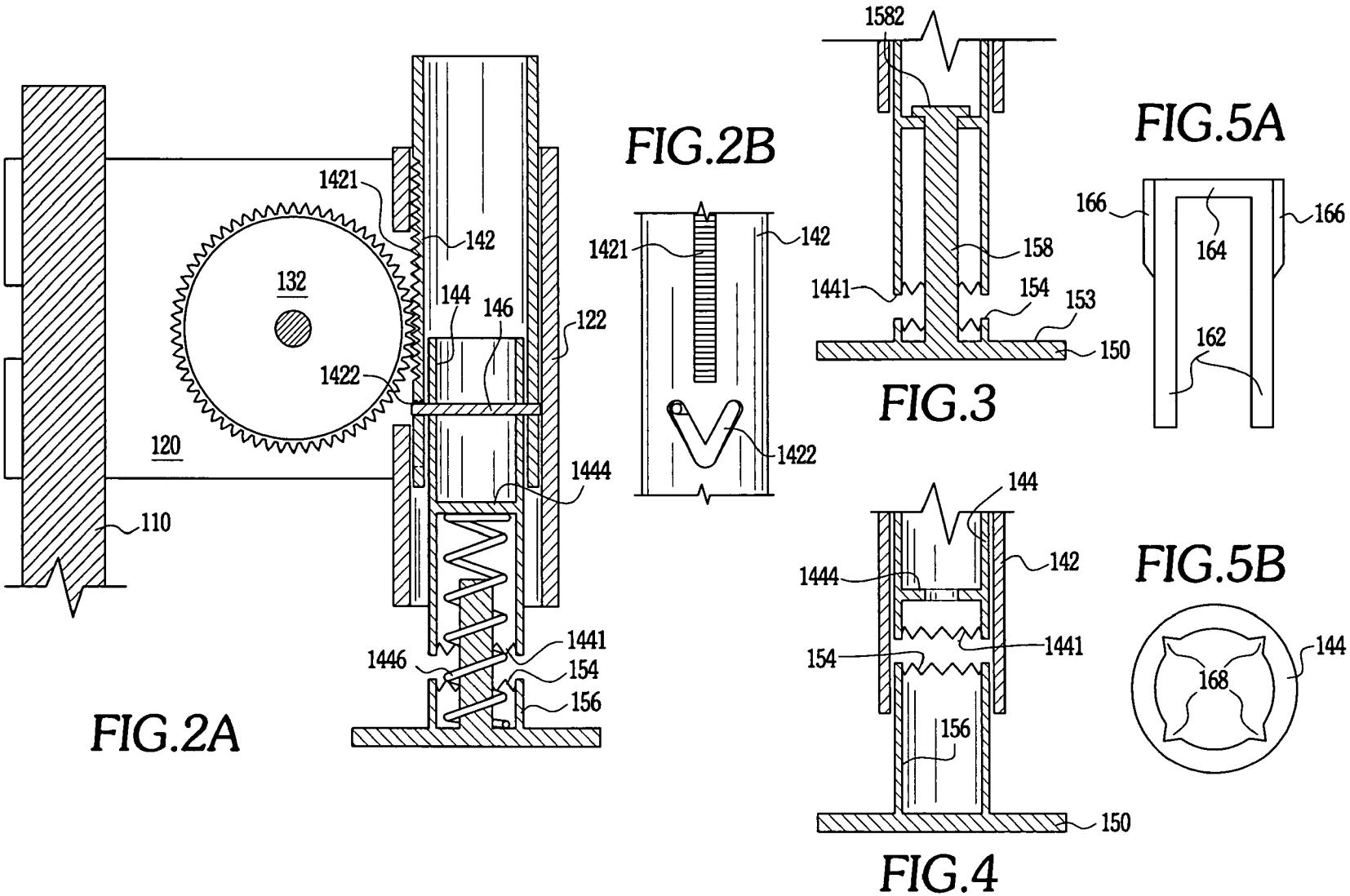
FIG. 2A depicts a cross-sectional view taken at 2A-2A in FIG. 1B of an upper portion of the exemplary embodiment shown in FIG. 1B.
FIG. 2B illustrates a side view of a portion of the outer shaft of the exemplary embodiment of FIGS. 1A-2A.
FIGS. 3 and 4 depict alternative arrangements of the shafts and engagement head of the exemplary embodiment of FIGS. 1A-2A.
FIG. 5A illustrates a side view of an alternative component for use with an alternative exemplary embodiment.
FIG. 5B depicts a top view of the inner shaft for use with the component illustrated in FIG. 5A.

FIGS. 2A and 2B illustrate an exemplary drive system 140 that includes an outer shaft 142 that includes a plurality of teeth 1421 as illustrated in, for example, FIG. 2B along its surface for engagement by the gear 132 in a rack and pinion configuration.

FIGS. 2A and 2B illustrate an inner cylindrical member 144 being connected to the outer cylindrical member 142 with a pin(s) 146 to convert vertical movement into rotational movement. Depending upon the arrangement there may be one pin 146 that transverses the diameter of the inner cylindrical member 144 or a pair of pins 146 extending from opposing sides of the inner cylindrical member 144. The inner cylindrical member 144 is illustrated as being fixedly connected to the pin(s) 146. The pin(s) 146 slidingly engages V-shaped slots 1422 present on opposing surfaces of the outer cylindrical member 144 as illustrated in, for example, FIGS. 2A and 2B. The V-shaped slots 1422 allow the device to open and close lids depending on which halves of the V-shaped slots 1422 are used. If the left side of the V-slot is used, then the lid will be closed from the container. If the right side of the V-slot is used, then the lid will be opened from the container. On the inside of the inner cylindrical member 144 and at a point below the pin(s) 146, a barrier 1444 on which a spring (or other compression resistant mechanism) 1446 is mounted or in communication with. The spring 1446 also assists in resetting the device after use. This exemplary embodiment could further include a selector switch (not shown in FIGS. 2A and 2B) connected to a covering that would be slid over half of the V-slot to allow the user to select whether they wanted to loosen or fasten a lid to a container.

Alternatively, the outer cylindrical member 142 can connect to the inner cylindrical member 144 with a pin(s) 146 with a similar cross-section as that illustrated in FIG. 2A. The outer cylindrical member 142 would preferably fixedly connect to the pin(s) 146. The pin(s) 146 would preferably slidingly engage V-shaped slots present on opposing surfaces of the inner cylindrical member 144. The V-shaped slots would allow the device to open and close lids depending on which halves of the V-shaped slots are used.

Under either of the above described exemplary embodiments, the inner cylindrical member 144 as illustrated includes a plurality of teeth (or other protrusions for gearing) 1441 around the bottom of the inner cylindrical member 144 to engage reciprocating teeth (or other protrusions for gearing) 154 around the top of the engagement head 150. The engagement head 150 as illustrated includes a bottom surface 152 and a plurality of teeth 154 on its top. The various illustrated engagement heads in this disclosure preferably have a rubber surface or a Dycem™ surface to better grip and engage lids 192. Alternatively, the bottom of the engagement heads may have a socket (not shown) having a conical (or partially conically) interior lined with a gripping material like rubber or Dycem™ that would allow different size lids to be open by the device.

The plurality of teeth may be formed as illustrated, for example, in FIG. 3 (spring 1446 is omitted for clarity) on the top surface 153 of the engagement head 150 or in FIGS. 2A and 4 on the top of a cylindrical member 156 extending up from the top surface 153 of the engagement head 150. FIG. 4 (spring 1446 is omitted for clarity) also illustrates an exemplary embodiment where the outer cylindrical member 142 overlaps with the cylindrical member 156 thus strengthening the engagement that occurs between the inner cylindrical member 144 with engagement shaft 156 and covering the spring 1446. The engagement head 150 as illustrated in FIG. 3 includes a restraining post 158 extending up from the top surface 153 to restrain the spring 1446, which preferably is attached to the top surface 153; however, the post 158 may be omitted from the device. FIG. 3 illustrates the post extending up for a distance sufficient to overlap with the inner cylindrical member 144, while FIG. 4 illustrates the post 158 extending up and through an opening in the barrier 1444 so that when the device is not engaging a container 190, the post 158 is able to hang from the barrier with top 1582.

FIG. 5A illustrates a selector apparatus (or switch mechanism or operation switch) for use with the exemplary embodiment with V-shaped slots on the inner cylindrical member (or selector sleeve) 144 that includes a pair of arcuate plates 162 depending from a dial 164 that allows the user to select whether the device should open or close a lid of a container. The selector switch engages the inside of the inner cylindrical member 144 with a protrusion 166 such as a ridge or extended tooth and a reciprocating channel 168 shaped to engage the protrusion, while alternatively the protrusion may be present on the inside of the inner cylindrical member 144 with the channels being present on the selector switch. As illustrated in FIG. 5A, the protrusion may be present on each of the arcuate plates for engagement of channels running down from the top of the inner cylindrical member 144. As illustrated in FIG. 5B, there are two sets of channel pairs to allow the selector switch to switch between an open state and a close state.

The user sets the device for opening or closing a lid 192 of a container 190 and also places the container 190 onto the base 100 below the engagement head 150. The user pulls the handle 130 towards them and away from the post 110 to lower the drive system 140 and the engagement head 150 towards the lid 192. The spring 1446 begins to compress when the engagement head 150 contacts the lid 192 and pushes to a disengagement state from the container 190, i.e., the lid 192 is able to be rotated relative to the container 190. Once the teeth 1441, 154 of the inner shaft 144 and the engagement head 150 engage, additional lowering the handle 130 relative to the ground will result in the outer and inner cylindrical members 142, 144 turning the vertical movement of the outer cylindrical member 144 into rotation of the engagement head 150 and thus the lid 192.

Figure 6B:
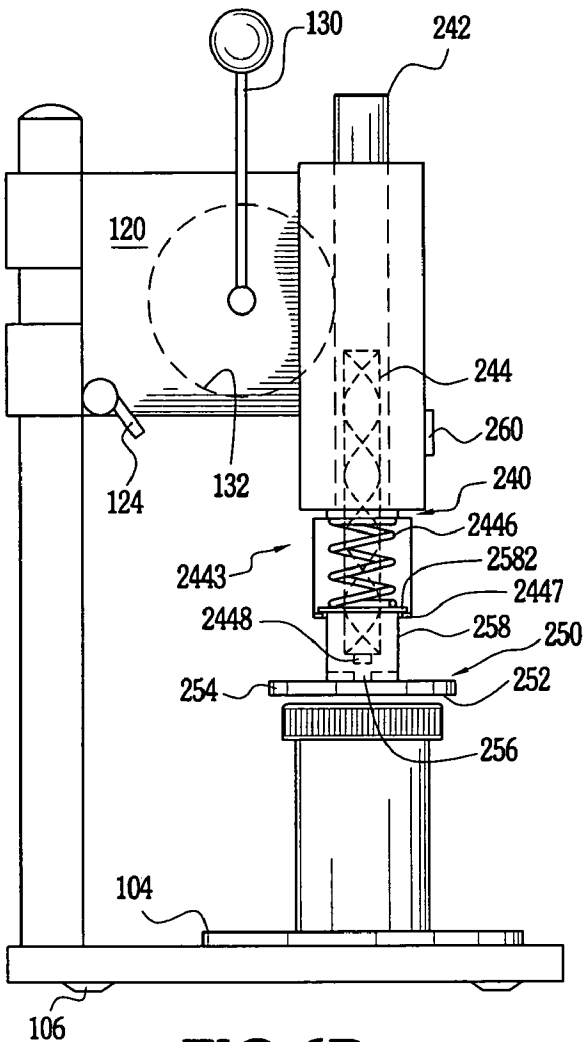
FIGS. 6B and 6C depict side views of the exemplary embodiment shown in FIG. 6A with internal components shown in phantom and a conceptual view of the interaction between a gear and an outer shaft. These figures illustrate operation of the exemplary embodiment.
Figure 6A:
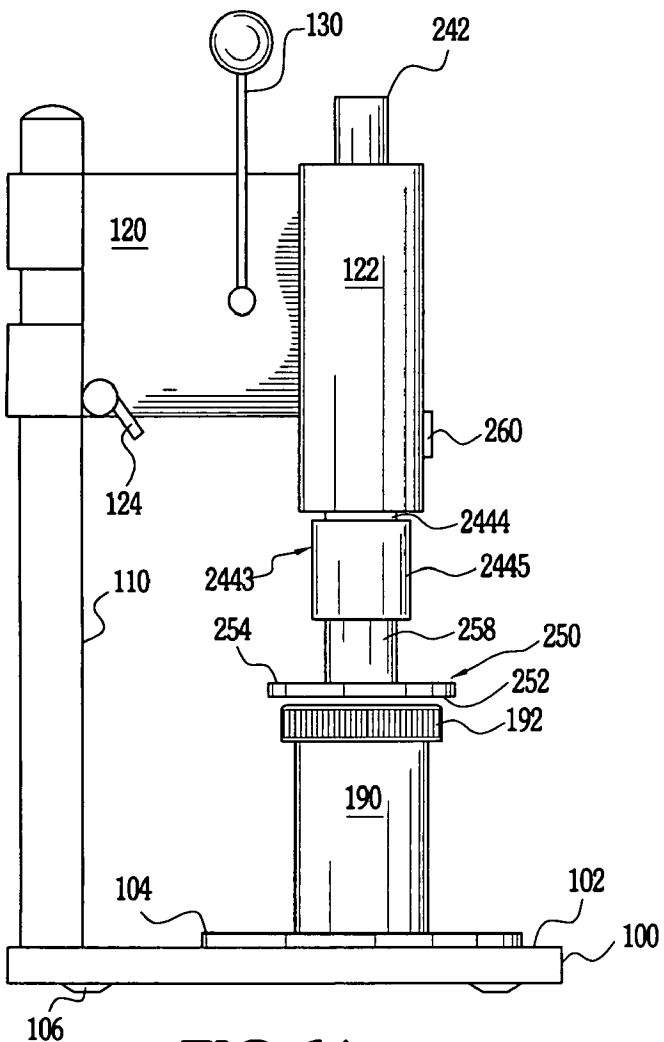
FIG. 6A illustrates a side view of an exemplary embodiment according to the invention.
Figure 6C:
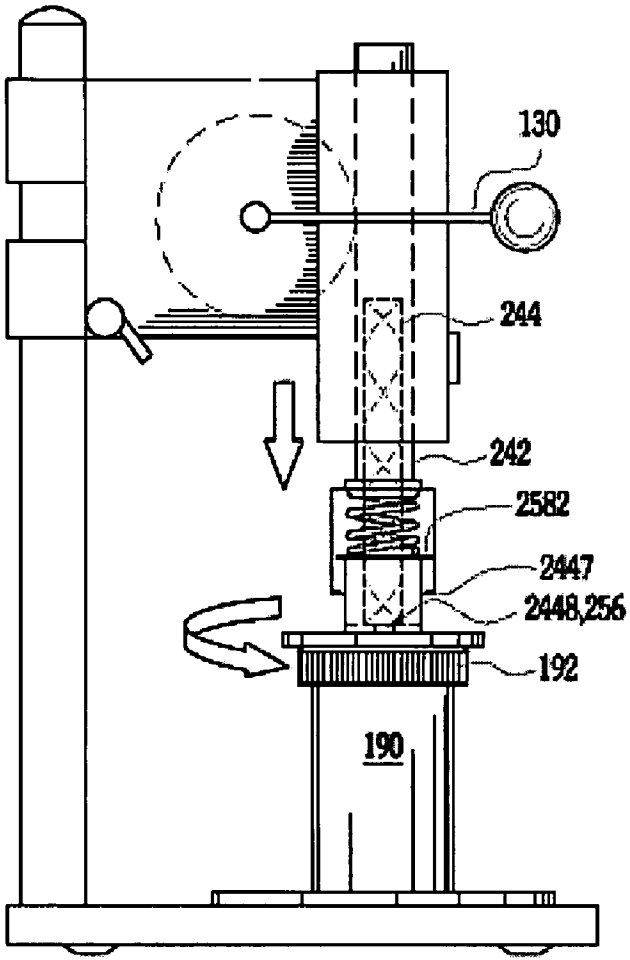

FIGS. 6A-6C illustrate another exemplary embodiment of the invention similar to the previous exemplary embodiment, but having a different structure for the drive system 240 and the engagement head 250. This illustrated embodiment also adds an adjustment lever 124 that locks in place the arm 120 relative to the post 110, which may also be incorporated into the exemplary embodiments shown in FIGS. 1A-5.

The drive system 140 includes an outer cylindrical member 142 and a spindle (or inner cylindrical member) 244 as illustrated in phantom in FIGS. 6B and 6C. The illustrated spindle 244 includes a socket 2443 and spiral grooves 2442 on the outside surface for engaging at least one pin(s) (or protrusion(s)) 246. Once the spindle 244 becomes engaged with the engagement head 250, any additional downward movement of the outer cylindrical member 142 will cause the spindle 244 to rotate. The socket 2443 as illustrated includes a top (or barrier) 2444 connected to the spindle 244 and a cylindrical member (or sleeve) 2445 depending from the top 2444. Attached to the top 2444 is a spring 2446 that encircles the portion of the spindle 244 present in the socket 2443. The cylindrical member 2445 as illustrated includes an internal rim 2447 around the bottom for restraining the engagement head 250. As illustrated, the spindle 244 includes a tip 2448.

The engagement head 250 includes a bottom surface 252, a top surface 254 having a groove (or channel or recess) 256, and a cylindrical member 258 with a rim 2582 around its top for engaging the rim 2447. The top of the cylindrical member 258 is in communication with the spring 2446. The groove 256 is engaged by the tip 2448 during use to apply the rotational force to open/close the lid.

Also illustrated in, for example, FIG. 6A, is an operation (or selector) switch 260 that allows the user to select whether they want to open or close the lid 192 on the particular container 190.

During use of the device, the user places the container 190 with the lid 192 below the engagement head 250 using, for example, the circular ridges 104 as a guide for centering the container 190. The user selects the desired operation with the operation switch 260. FIG. 6B illustrates the device in its start state. The user pulls the handle 130 towards them to rotate the gear 132 and move the outer cylindrical member 142 down and as a result lower the engagement head 250 into contact with the lid 192. After the engagement head 250 contacts the lid 192, the spring 2446 is compressed as the engagement head 2448 is lowered into engagement with the groove 256 as illustrated in FIG. 6C. As further pressure is applied via the handle 130, the lid 192 will be pushed down on and disengaged from the container 190, which will allow the lid 192 to rotate relative to the container 190. At this point, as the handle 130 is pushed lower, the pin(s) 246 begin to travel along the spiraling grooves 2442 resulting in vertical movement of the handle 130 being translated into rotational movement of the tip 2448, which in turn rotates the engagement head 250 and the lid 192 as illustrated by the arrows present in FIG. 6C.

FIGS. 7A-7D illustrate another exemplary embodiment of the invention that includes a base 100, a post (or support member) 310 with a slide track 312 attached thereto, a slide mechanism 320, a lever (or handle) 330, a drive system 340, and an engagement head 350. The post 310 as illustrated includes a pair of rollers 316 extending from either side of the post 310. The rollers 316 are in rolling contact with the lever 330. Although illustrated as being two separate components, post 314 and the slide track 312 may be formed together as a unitary piece.

The illustrated embodiment drive system 340 includes a rotation driver mechanism 370, a telescoping cylindrical member 343, a spring 2446, and a pair of washers 348 connected by a pair of strands 349.

The slide mechanism 320 preferably is biased upwards, and an exemplary way to accomplish this is by having a spring present between the slide mechanism 320 and the slide track 312. The slide mechanism 320 includes a slide piece 322, a spacer member 324, and a bracket (or arm) 326. The slide mechanism 320 alternatively can be considered to be part of the drive system 340 in that it lowers the drive system 340 onto the lid 912. For example in FIG. 7A, the rotation driver 370 is attached to the spacer member 324 and the slide piece 322 with bracket 326; however, one of ordinary skill in the art will appreciate based on this disclosure that these elements could be combined in a variety of ways to, for example, reduce the number of separate components. The lever 330 attaches to the spacer member 324 and slides about the rollers 316.

Figure 7D:
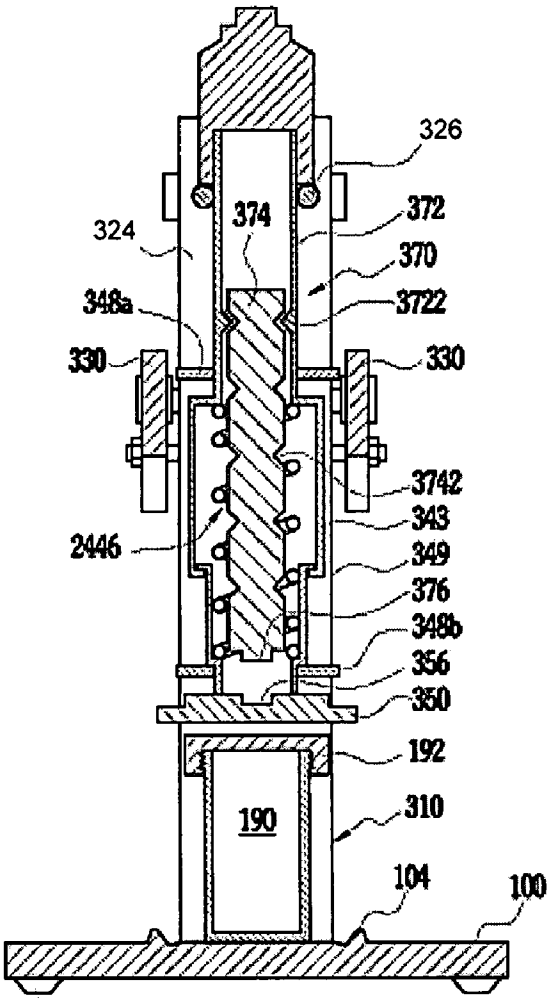
FIG. 7D depicts a cross-sectional view taken at 7D-7D in FIG. 7A.
Figure 7C:
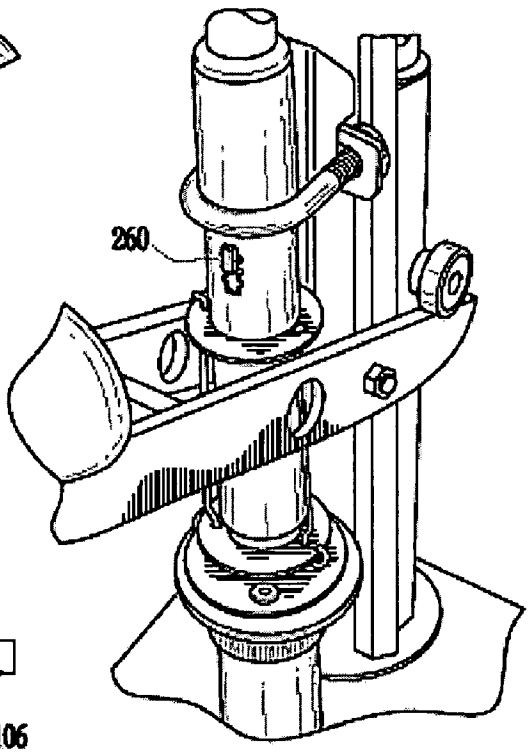
FIG. 7C illustrates an enlargement of a portion of the exemplary embodiment illustrated in FIG. 7A.
Figure 7B:
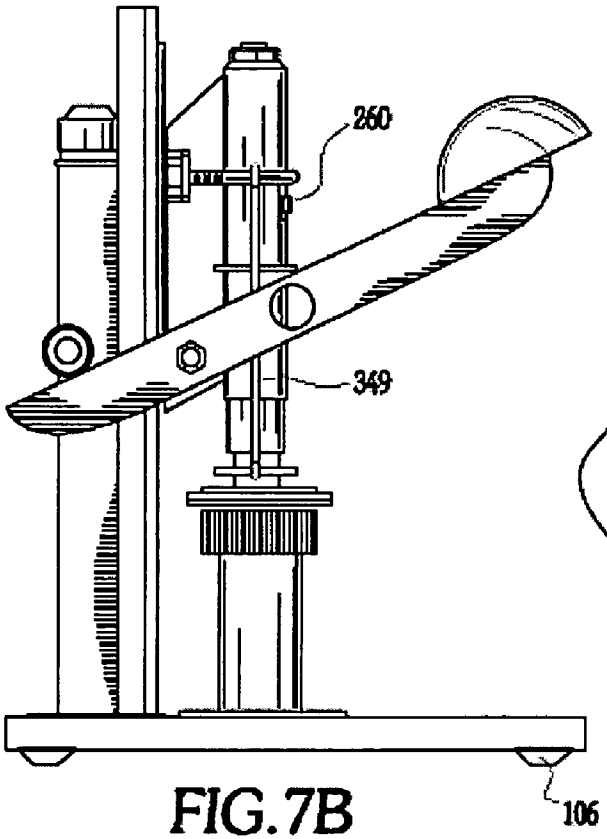
FIG. 7B depicts a side view of the exemplary embodiment illustrated in FIG. 7A.

An exemplary rotation driver mechanism 370 is a Yankee screwdriver or similar mechanism. The rotation driver mechanism 370 as illustrated includes an operation switch 260 for changing the operation of the device between opening and closing. In FIG. 7D, the rotation driver mechanism 370 is depicted as having an outer cylindrical member 372 having a pair of posts 3722 that slide in at least one set of grooves 3742 of a spindle 374; however, the posts 3722 could number one or more. The operation switch 260 controls which set of grooves 3742 the posts 3722 slide in during use of the device. In FIG. 7D, the spindle 374 extends down through the telescoping cylindrical member 343 and is capable of engaging an opening (or recess) 356 in the engagement head 350 with a tip (or end) 376. Once the tip 376 engages, any additional force applied to the outer cylindrical member 372 will cause the posts 3722 to travel along the grooves 3742 and cause the spindle 374 to rotate.

Attached to the rotation driver 370 is a washer 348*a* and on the other side of the washer 348*a* is the telescoping cylindrical member 343. The illustrated telescoping cylindrical member 343 includes an outer shaft and an inner cylindrical member in telescopic engagement with each other, and if the inner and outer cylindrical members are interconnected, then the strands 349 may be omitted. Within the telescoping shaft 343 is a spring 3446 to provide resistance to the compression and provide a delay period during which the lid is unlocked on a child-proof container prior to rotation occurring. At the bottom end of the telescoping cylindrical member 343 is a second washer 348*b*, which would be omitted if no strands 349 are used, connected to the first washer 348*a* through the illustrated strands 349.

Passing through the telescoping cylindrical member 343 and the spring 3446 is the spindle 374 having the tip 376 shaped to engage a reciprocal opening (or recess) 356 in the top surface of the engagement head 350 upon compression of the spring 3446 and contact between the engagement head 350 and the lid 192.

To use the illustrated device, the user places the container 190 and the lid 192 below the engagement head 350 and checks to see if the operation switch 260 is set to the desired operation. The user pushes down on the lever 330 causing the slide mechanism to lower and push the engagement head 350 towards the lid 192. The lever 330 rotates about the connection with the spacer member 3412 while sliding against the rollers 316, which provide a pivot point for the lever 330 and allows it to pull the drive system 340 down. When the engagement head 350 contacts the lid 192 and the spring 3446 has compressed, the lid 292 will be pushed down and disengaged from the container 290. As additional downward vertical movement of the handle 330 occurs, the rotation driver 370 and the spindle 374 translate the vertical movement into rotational movement of the engagement head 350 and thus the lid 192.

Figure 8A:
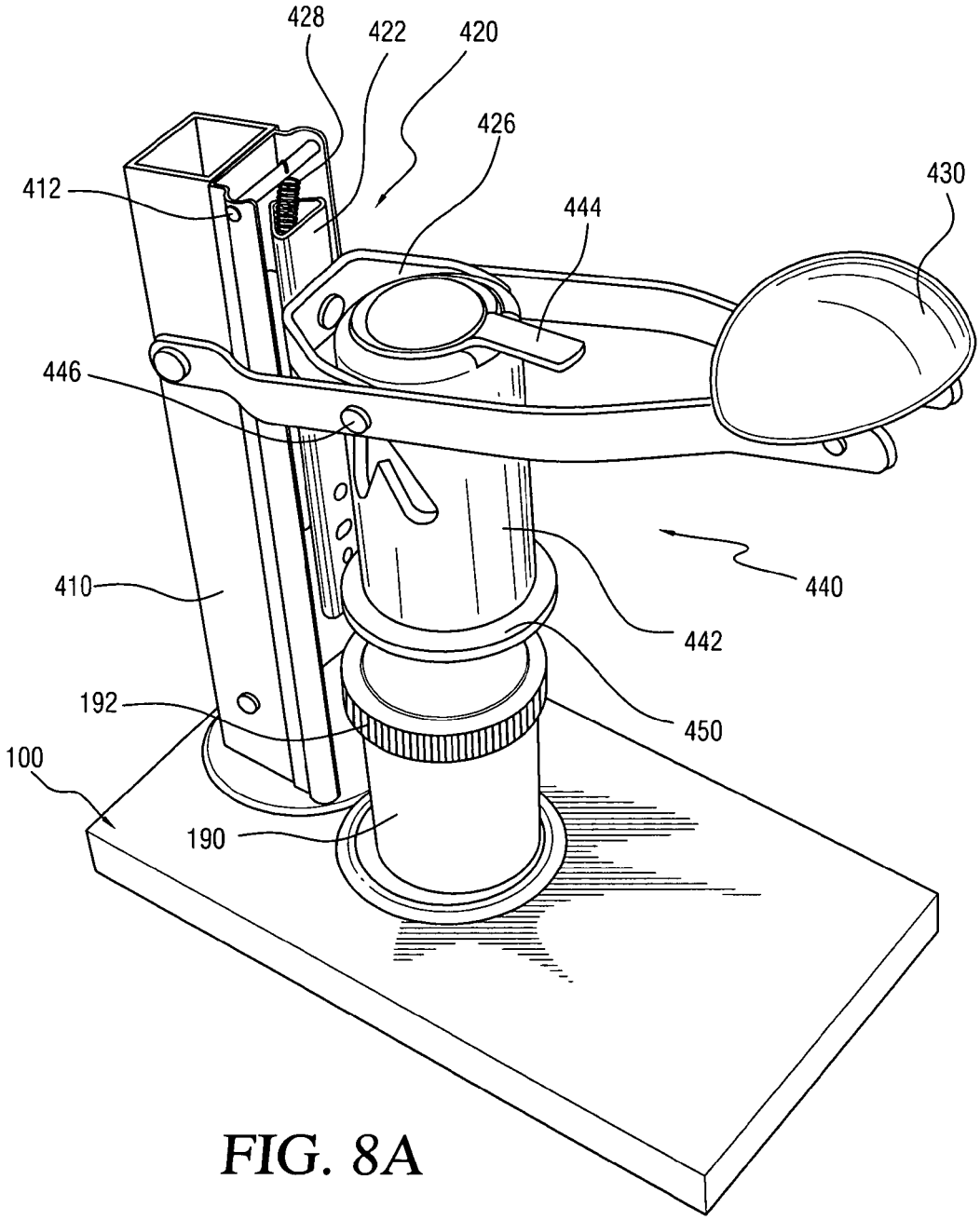
FIG. 8A illustrates a perspective view of an exemplary embodiment according to the invention.

FIGS. 8A-8D illustrate another exemplary embodiment that shares a similar structure to the embodiment illustrated in FIGS. 7A-7D with the primary differences being the drive system and the connection points for the lever. FIG. 8A illustrate another exemplary embodiment of the invention that includes a base 100, a post 410 with a slide track 412, a slide mechanism 420, a lever (or handle) 430, a drive system 440, and an engagement head 450. The illustrated lever 430 is connected to the post 410 to allow the lever 430 to pivot about that point during use. The lever 430 is also connected to the slide mechanism 420, which connects to the drive system 440.

Figure 8B:
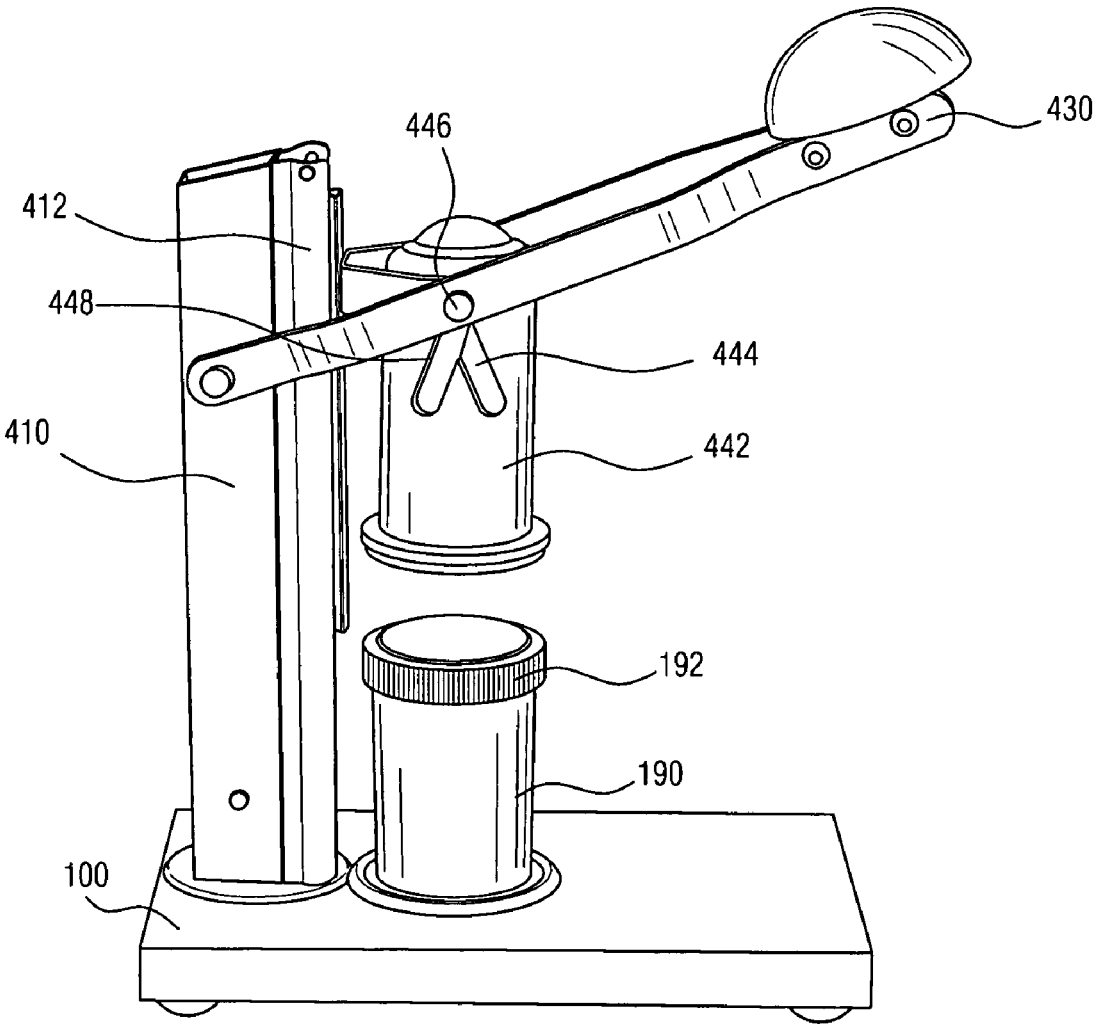
FIG. 8B depicts a side view of the exemplary embodiment illustrated in FIG. 8A.

FIGS. 8A and 8B illustrate the slide mechanism 420 as being biased upwards, and an exemplary way to accomplish this is by having a spring 428 connecting the slide mechanism 420 and the slide track 412. To facilitate the sliding engagement between the slide mechanism 420 and the slide 412, a plurality of bearings may be disposed between them. The slide mechanism 420 includes a slide piece 422 and a bracket (or arm) 426. The slide piece 422 engages the slide track 412, while the bracket 426 supports the drive mechanism 440 with a support bar 446 connecting the lever 430 and the bracket 426 together.

Figure 8C:
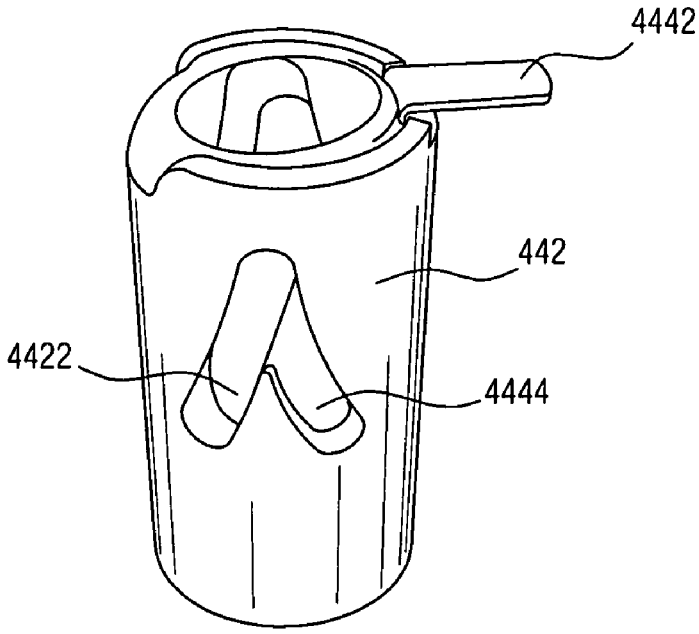
FIGS. 8C and 8D illustrate exemplary components of the exemplary embodiment illustrated in FIG. 8A.
Figure 8D:
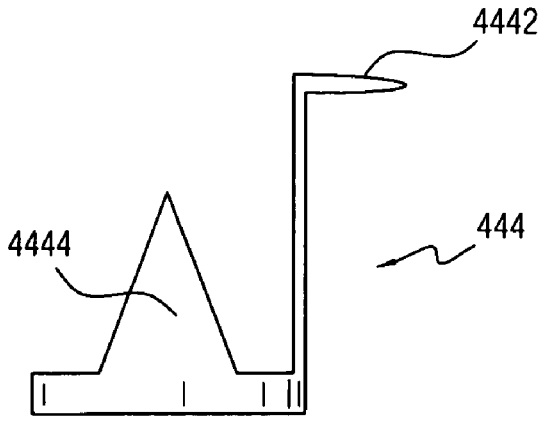

FIG. 8C illustrates the selector (or inner cylindrical member) 444 and outer cylindrical member 442 (separated from the engagement head 450) that form the drive system 440 in conjunction with a support bar 446 such as the illustrated bolt 446 in FIGS. 8A and 8B and spring 448. The illustrated selector 444 has two positions that control the rotation of the engagement head 450 by directing the support bar 446 down one channel or the other channel of the illustrated V-shaped slot 4422, which is an upside down V, of the outer cylindrical member 442. If the left channel is open, then the lid will be loosened from the container. If the right channel is open, then the lid will be tightened on the container. Although the selector 444 is illustrated as having a control lever 4442 connected to solid portions 4444 to cover one channel of each of the V-shaped slots 4422, a variety of other structures can be used that would still facilitate blocking a portion of the V-shaped slot 4422. The selector 444 may take a variety of configurations for blocking a portion of the V-shaped slot 4422 with exemplary configurations illustrated in FIGS. 8C and 8D. FIG. 8A illustrates the drive system 440 as including a cover 441 on top of the inner cylindrical member 444, which is optional as it does not impact the functioning of the drive means.

The spring 448 is located between the support bar 446 and the engagement head 450, which in the illustrated embodiment is connected to the outer cylindrical member 442 to hold the spring 448 in place. The spring 448 facilitates the return of the support bar 446 to its starting position after compression of the spring 448 during use. The spring 448 is not compressed until the engagement head 450 contacts the lid 192 of the container 190. However, as the lever 430 is moved downwards the lid 192 is pressed down on the container 190 to allow the lid 192 to rotate, the support bar 446 moves down the available portion of the V-shaped slot 4422 to turn the outer cylindrical member 442 and rotates the engagement head 450.

FIGS. 9A-9E illustrate another exemplary embodiment of the invention that converts movement of a lever into opening or closing a lid on a container. The illustrated embodiment includes a base 500, a support member (or post) 510, a handle 530, and a drive system 540. The base 500 and the support member 510 as illustrated are an integral unit. The support member 510 includes a track 512 for the drive system 540 and the container 190 to travel and/or rest in.

The handle 530 is connected to a gear 532 of the drive system 540 to translate the movement of the handle 530 into movement of the drive system 540 down the track 512 to engage the container 190. In one exemplary embodiment, the device includes a pair of return springs that are compressed by the handle 530 during use to assist the handle in returning to the start position.

Figure 9A:
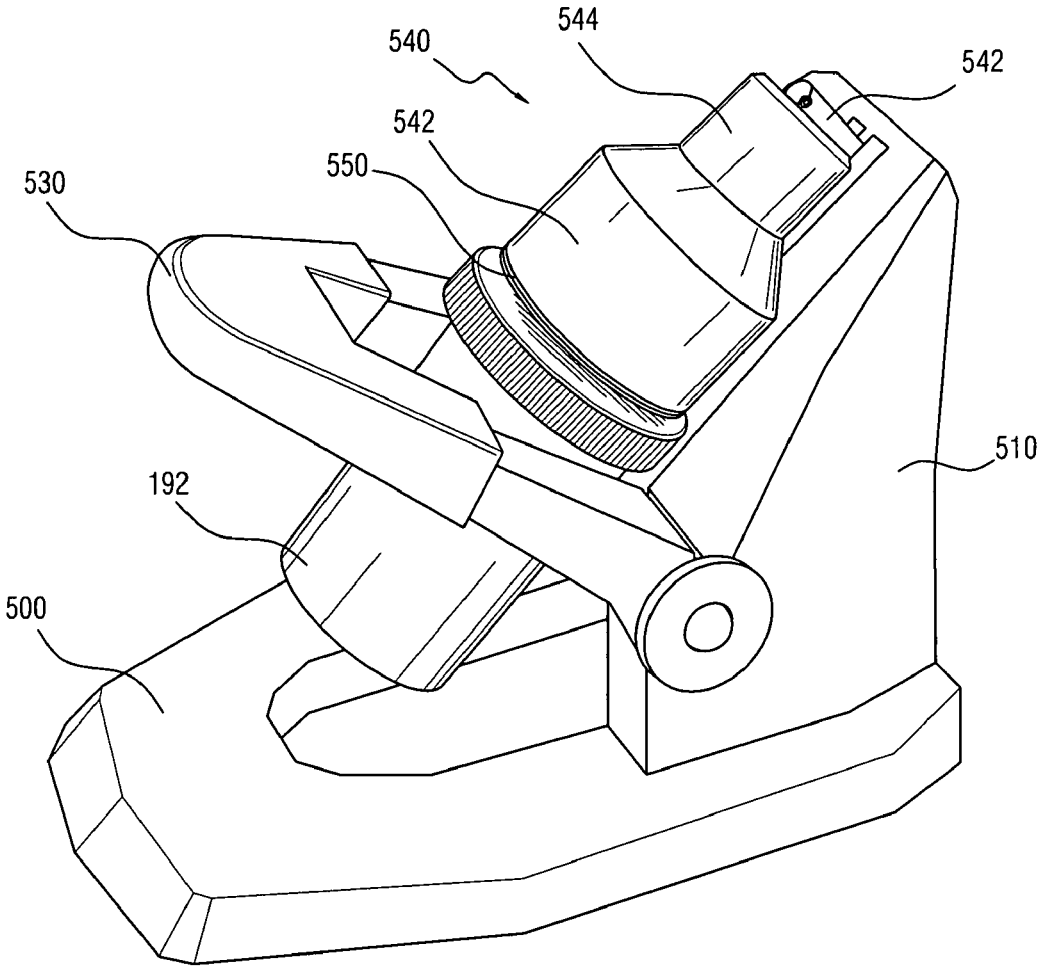
FIGS. 9A and 9B depict another exemplary embodiment according to the invention.
Figure 9B:
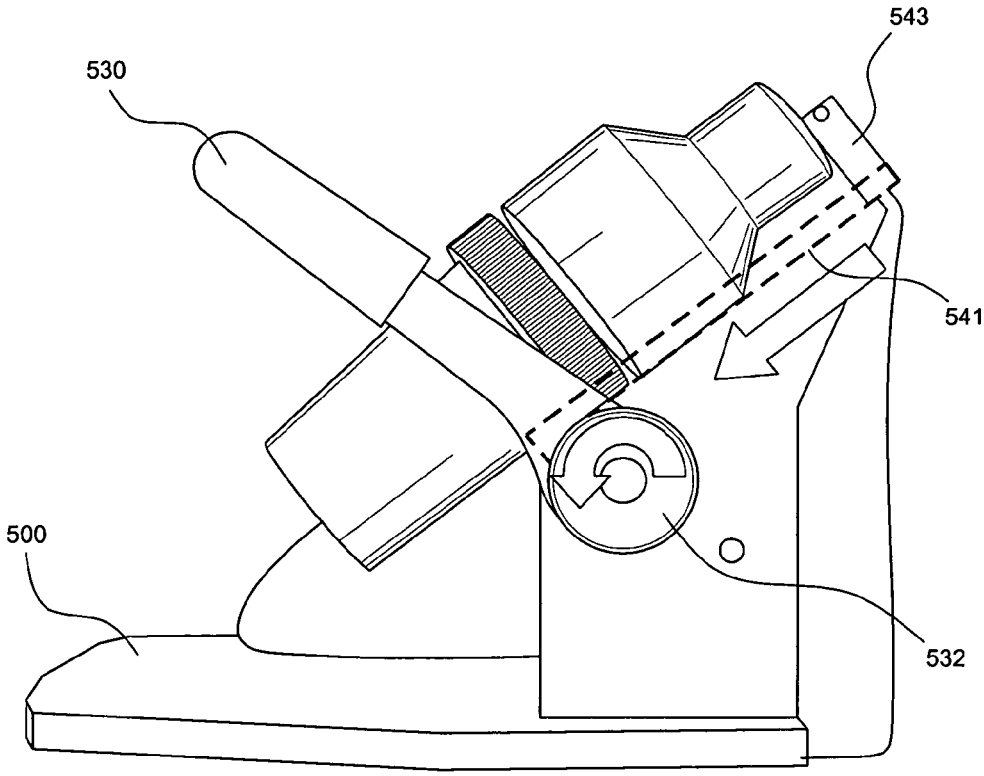
Figure 9C:
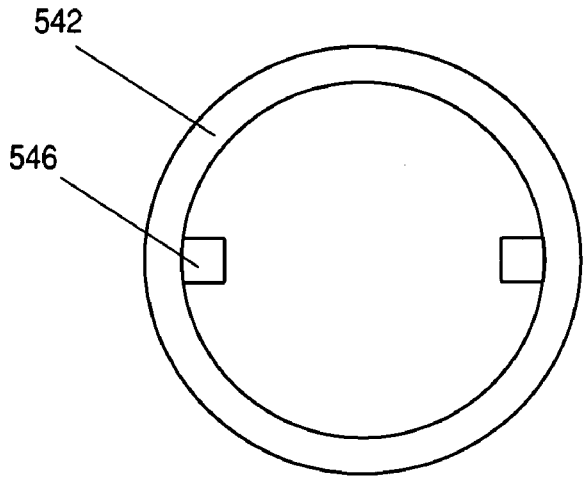
FIGS. 9C-9E illustrate exemplary components for the exemplary embodiment illustrated in FIGS. 9A and 9B.
Figure 9D:
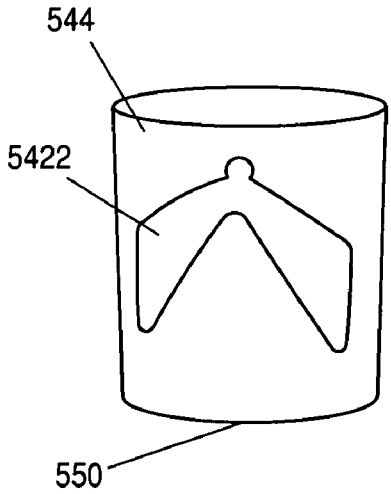
Figure 9E:
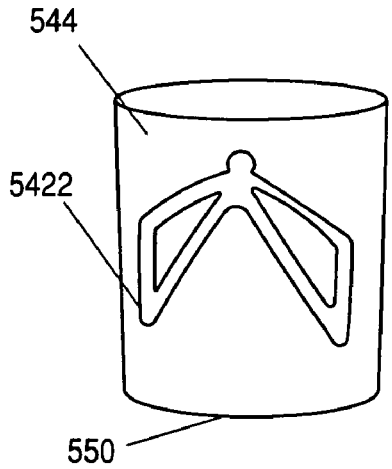

The drive system 540 includes an arm 541 that has a plurality of teeth at one end to engage the gear 532 connected to the handle 530. The arm 541 is connected to a drive arm 543 that abuts an inner cylindrical member 544 that is nested in an outer cylindrical member 542 down the track 512. The outer cylindrical member 542 includes a pair of protrusions (or posts) 546 that extend towards its center as illustrated in FIG. 9C. The posts 546 engage an inner cylindrical member 544 that includes an upside down V-shaped slot 5422 with a return area to guide the posts 546 during use. Once the outer cylindrical member 542 contacts a container 190, the posts 546 move down the slot 5422 and down one side or the other of the V-shaped slot depending upon whether the lid is being opened or closed. FIG. 9D illustrates the V-shaped slot 5422 as an opening (although it could be an indentation into the wall) that will facilitate locating the selector sleeve (similar to the selector sleeve 444) on the inside of the inner cylindrical member 544, although the selector sleeve could be between the outer cylindrical member 542 and the inner cylindrical member 544. FIG. 9E illustrates the slot 5422 as a groove pattern cut into a wall of the inner cylindrical member 544 where the selector sleeve would be between the outer cylindrical member 542 and the inner cylindrical member 544. The V-shaped slots 5422 can be substituted for the previously described V-shaped slots, and vice versa.

The outer cylindrical member 542 is connected to an engagement head 550. The inner cylindrical member 544 includes a plate (or barrier) spaced from one end. A spring is located between the engagement head 550 and the plate of the inner cylindrical member 544 to provide a return force for the device.

Figure 9F:
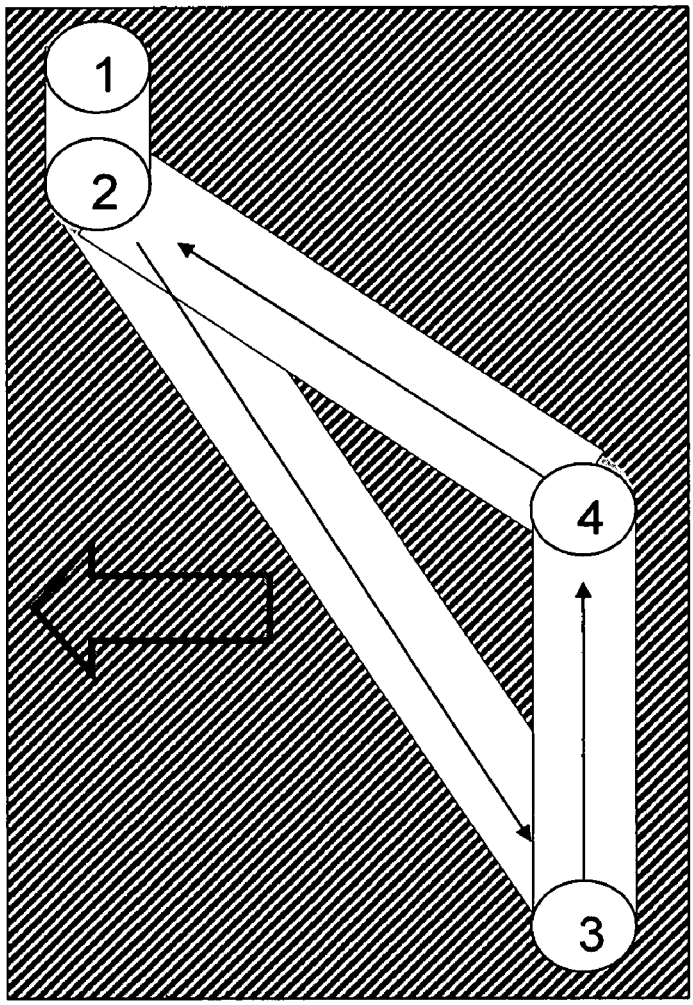
FIG. 9F depicts a path of a pin during use.

FIG. 9F illustrates the path of the posts 546, with point 1 being the starting position. Point 2 is indicative of where there is partial spring compression as the lid 192 is pressed down on the container 190, with continued pressure and travel towards point 3 resulting in lid rotation. Point 3 is indicative of full spring compression and completion of the loosening/tightening of the lid. The path from point 3 to point 4 illustrates release of the spring while avoiding the possibility of reversing what has occurred. The path from point 4 to point 2 and then to point 1 illustrates the continual release of the spring. The arrows in FIG. 9B illustrate how rotation of the gear 532 translates to movement of arm 541.

One of ordinary skill in the art will appreciate based on this disclosure how the above relationship between the outer cylindrical member and the inner cylindrical member can be used in connection with the other illustrated exemplary embodiments that utilize a V-shaped slot and how the reverse holds true.

Figure 10:
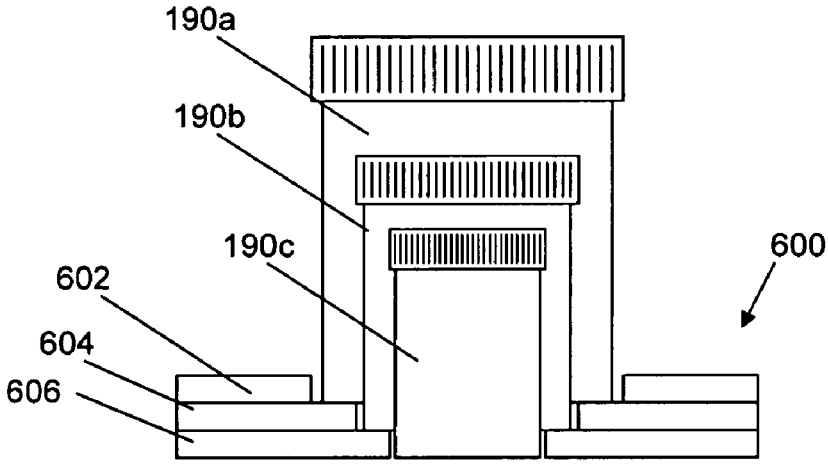
FIG. 10 illustrates an exemplary base component.

FIG. 10 illustrates an exemplary configuration for the base 600 where there are a plurality of sized recesses 602, 604, 606 (in place of the circular ridges 104 illustrated, for example, in FIG. 1A) for different sized containers 190*a*-190*c*, respectively, as illustrated.

The various above-described embodiments illustrate different means for converting movement of a handle (or lever) into downward pressure on a container lid prior to rotating the lid with direction of rotation selected by the user. In some exemplary embodiments, the means converts vertical movement of the handle into downward pressure and then lid rotation.

The various above described levers with accompanying components and with or without one of the exemplary described operation switches and/or covers are examples of a controlling means for controlling the operation of the device, i.e., the opening and closing of lids on respective containers. The various above described engagement head configurations are examples of a lid contacting means for contacting a lid of a container and rotating the lid. The various described driver means including in at least one embodiment the cam wedge are examples of a rotational means for rotating said lid contacting means in response to use of said controlling means. The various combinations of posts on the bases and the arms are examples of a means for placing the rotational means over the base.

An alternative embodiment would convert the illustrated embodiments into a handheld device where the post would include a handle area below the base.

The exemplary and alternative embodiments described above may be combined in a variety of ways with each other. When there is engagement between two different components, the engagement elements may be reversed between the two components.

As used above "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

Although the present invention has been described in terms of particular embodiments, it is not limited to those embodiments. Alternative embodiments, examples, and modifications which would still be encompassed by the invention may be made by those skilled in the art, particularly in light of the foregoing teachings.

Those skilled in the art will appreciate that various adaptations and modifications of the embodiments described above can be configured without departing from the scope and spirit of the invention. Therefore, it is to be understood that, within the scope of the appended claims, the invention may be practiced other than as specifically described herein.

I claim:

1. A device comprising:
- a base,
- a post connected to said base,
- a slide track connected to said post,
- a slide member in sliding engagement of said slide track,
- a bracket extending from said slide member away from said post,
- a lever connected to said post and said bracket,
- a bar connecting the free ends of said bracket and connecting said lever to said bracket,
- a cylindrical member depending from said bar, said cylindrical member having a closed bottom with a bottom surface and a pair of V-shaped slots on opposing sides of said outer shaft through which said bar passes,
- a spring located between said bar and said closed bottom of said cylindrical member, and
- a selector sleeve on the inside of said cylindrical member and around said spring, said selector sleeve having
  - a pair of cover members on opposing sides and
  - a member extending from the sleeve, said extending member abuts said cylindrical member.

2. The device according to claim 1, further comprising a second spring connecting said slide track to said slide member.

3. The device according to claim 1, wherein said post and said slide track are integrally formed together as a unitary piece.

4. The device according to claim 1, wherein said bracket and said slide member are integrally formed together as a unitary piece.

5. The device according to claim 1, wherein each of the cover members have a height sufficient to cover the one channel of a V-shaped slot.

6. The device according to claim 1, wherein said lever includes a grip area.

7. The device according to claim 6, wherein said grip area includes a hemispherical shape.

8. The device according to claim 1, wherein said lever includes two legs connecting to said post on opposing sides of said post at one end and connecting together at the other end.

9. The device according to claim 1, wherein said V-shaped slots have the V upside down.

10. A device for use in loosening and tightening lids onto containers, the device comprising:
- a base,
- a support member connected to said base,
- a lever in communication with said support member, and
- means for converting movement of said lever into downward pressure on a container lid prior to rotating the lid with direction of rotation selected by the user.

11. The device according to claim 10, wherein said support member includes a post.

12. The device according to claim 11, wherein said means includes
- a slide member in communication with said post, said slide member including a bracket connected to said lever,
- an engagement head having a cylindrical member extending from it, said cylindrical member having a pair of upside down V-shaped slots on opposing surfaces,
- a selector having means for blocking one leg of each of said V-shaped slots, and
- a bar passing through said cylindrical member between the free ends of said bracket.

13. The device according to claim 11, wherein said lever includes a hemispherical shaped grip area.

14. The device according to claim 11, further comprising an arm extending from said post, said lever in communication with said arm, and
- wherein said means includes
  - a gear connected to said lever,
  - an outer cylindrical member engaging said gear, said cylindrical member including at least one protrusion on an inner surface,
  - a spindle having
    - two spiral patterns, at least one pattern is in communication with said protrusion, and
    - a bit extending from a bottom of said spindle,
  - an engagement head having
    - a cylindrical member extending from it, and
    - an indentation complementing said bit,
  - a spring abutting said engagement member, and
  - a selector having means for locating said at least one protrusion in one of said two spiral patterns.

15. The device according to claim 11, wherein said means includes
- a slide mechanism in communication with said post,
- an arm extending from said slide mechanism and connected to said lever,
- an outer cylindrical member nested in said arm, said cylindrical member including at least one protrusion on an inner surface,
- a spindle having
  - two spiral patterns, at least one pattern is in communication with said protrusion, and
  - a bit extending from a bottom of said spindle,
- an engagement head having
  - a cylindrical member extending from it, and
  - an indentation complementing said bit,
- a spring abutting a portion of said engagement member, and
- a selector having means for locating said at least one protrusion in one of said two spiral patterns.

16. The device according to claim 15, wherein said means further includes
- at least one telescoping member connecting said outer cylindrical member to said cylindrical member of said engagement head, said telescoping member and said cylindrical member of said engagement head telescope together, said spindle passing through said telescoping member, and said spring restrained on the end closest to said arm by said top of said at least one telescoping member.

17. The device according to claim 16, wherein said means further includes a first washer around said at least one telescoping member, a second washer communicating with said engagement head, and a pair of restraining members on opposing sides connecting said first washer to said second washer.

18. The device according to claim 10, wherein said means includes a gear connected to said handle, an arm with a plurality of teeth, at least one tooth engages said gear, a drive arm connected to said arm, an inner cylindrical member in communication with said drive arm, said inner cylindrical member includes a pair of upside down V-shaped slots on opposing sides, an outer cylindrical member having a pair of posts for engaging a respective V-shaped slot of said inner cylindrical member, an engagement head connected to said outer cylindrical member, and a spring between said engagement head and said inner cylindrical member.

19. The device according to claim 18, wherein said means includes a selector sleeve having means for blocking a portion of the V-shaped slots.

20. An apparatus for fastening and unfastening twist cap containers, comprising:

a base, an upright member attached to said base, a lever attached to said upright member, a rotating member attached to said upright member and said lever, said rotating member in response to downward movement of said lever applies a rotating force on the container such that the twist cap is fastened or unfastened and;

a selector attached to said rotating member, wherein the position of said selector determines the direction of rotation of said rotating member.

21. The apparatus according to claim 20 wherein the position of said selector is determined by a user.

22. The apparatus according to claim 20, further comprising a slide attached to said upright member and said rotating member, wherein said slide allows said rotating member to move downward when a downward force is applied to said lever.

23. The apparatus according to claim 20, wherein said rotating member includes an engagement head.

24. The apparatus according to claim 20, wherein said base includes at least one non-slip portion.

* * * * *